US010737375B2

(12) United States Patent
Zhu

(10) Patent No.: US 10,737,375 B2
(45) Date of Patent: Aug. 11, 2020

(54) WORKBENCH

(71) Applicant: JINHUA WIS TOOLS CO., LTD, Jinhua, Zhejiang (CN)

(72) Inventor: Hansong Zhu, Zhejiang (CN)

(73) Assignee: JINHUA WIS TOOLS CO., LTD, Jinhua, Zhejiang (CN)

( * ) Notice: Subject to any disclaimer, the term of this patent is extended or adjusted under 35 U.S.C. 154(b) by 293 days.

(21) Appl. No.: 15/783,654

(22) Filed: Oct. 13, 2017

(65) Prior Publication Data

US 2019/0047135 A1 Feb. 14, 2019

(30) Foreign Application Priority Data

Aug. 10, 2017 (CN) ..... 2017 2 0995275 U

(51) Int. Cl.
*B25H 1/04* (2006.01)
*B25H 1/16* (2006.01)
*B25H 1/08* (2006.01)

(52) U.S. Cl.
CPC ..... *B25H 1/04* (2013.01); *B25H 1/08* (2013.01); *B25H 1/16* (2013.01)

(58) Field of Classification Search
CPC .. B25B 5/00; B25B 11/00; B25H 1/00; B25H 1/04; B25H 1/08; B25H 1/10; B25H 1/005; B25H 1/12
USPC ..... 269/16, 134, 136, 139, 291, 309; 180/19.1; 446/487
See application file for complete search history.

(56) References Cited

U.S. PATENT DOCUMENTS 1,693,633 A * 12/1928 Allen ..... B60N 2/2848 280/31
5,862,842 A * 1/1999 You ..... B25B 1/125 144/286.1
6,530,302 B1 * 3/2003 Rogers ..... B23Q 16/001 144/136.95

(Continued)

OTHER PUBLICATIONS

TOVOT 4 Pack of Adjustable Furniture Leg Leveling Glides/Screw on Adjustable Furniture Table Chairs Levelers with Nut Jun. 16, 2017 (https://www.amazon.com/TOVOT-Adjustable-Furniture-Leveling-Levelers/dp/B07R58RG45/ref=sr_1_11?keywords=chairs+swivel+feet&qid=1568226153&s=gateway&sr=8-11 (Year: 2017).*

(Continued)

*Primary Examiner* — Tyrone V Hall, Jr.
*Assistant Examiner* — Abbie E Quann
(74) *Attorney, Agent, or Firm* — Birch, Stewart, Kolasch & Birch, LLP

(57) ABSTRACT

The invention provides a workbench having an operating panel and supporting leg for supporting the operating panel from below, which is characterized by that: the operating panel is provided with grooves therein, in which a handle is fitted detachably; the handle includes a first handle section and a second handle section which are provided in parallel, and a third handle section which connects the top end of the first handle section and the top end of the second handle section; and the bottom ends of the first handle section and the second handle section are rotatably mounted in the grooves. The workbench disclosed in the invention has different feeling during customers' use and better humanization design with less operation difficulty compared with conventional table.

19 Claims, 14 Drawing Sheets

(56) References Cited

U.S. PATENT DOCUMENTS

| | | | | |
|---|---|---|---|---|
| 6,758,482 | B2 * | 7/2004 | Stallbaumer | B62B 1/002 280/47.18 |
| 7,055,899 | B2 * | 6/2006 | Zhurong | A47B 3/0912 108/132 |
| 2011/0227302 | A1 * | 9/2011 | Gillespie | B25H 5/00 280/32.6 |
| 2012/0133112 | A1 * | 5/2012 | Myrant | B62B 1/208 280/655 |
| 2013/0118818 | A1 * | 5/2013 | Smith | B25H 1/04 180/19.1 |

OTHER PUBLICATIONS

The Hillman Group 43965 3/16x3-inch single hole clevis pin, stainless steel, 4-pack (https://www.amazon.com/Hillman-Group-43965-3-Inch-Stainless/dp/B00IZFQML8/ref=sr_1_15?keywords=bolts+with+pin+holes&qid=1568308951&sr=8-15). (Closest date was determined by comment section) (Year: 2012).*

* cited by examiner

WORKBENCH

TECHNICAL FIELD

The invention relates to a technical field of a multifunctional operating tool, particularly, to a workbench.

BACKGROUND

Conventional workbench generally include a body, a workbench surface and a workbench frame, and has a simple structure and a single function. Some tables has a rolling function, but its roller mostly has a stationary structure and it does not have a brake. The roller with a stationary structure has several disadvantages: 1) it may causes the volume of the packing of the whole workbench to be too big, resulting in space waste and increased transportation cost; 2) it is a potential danger to a child who plays near the workbench when the workbench is used at home, due to slide of the roller. The user has a require on improving the table, while the present workbench is relatively limited on extend capability and has an inflexible connection way between the panel and the legs, which provides poor experience feeling to the user.

Therefore, there is a need on designing a new workbench which can overcome the defects of the conventional tables.

SUMMARY OF INVENTION

The invention has an objective to providing a workbench which overcomes the defects in the art. The invention has some advantages, such as multiple functions, high stability, small volume, strong extend capability, convenient storage, good security and good experience feeling, etc.

The invention provides a workbench having an operating panel and supporting leg for supporting the operating panel from below, which is characterized by that: the operating panel is provided with grooves therein, in which a handle is fitted detachably; the handle includes a first handle section and a second handle section which are provided in parallel, and a third handle section which connects a top end of the first handle section and a top end of the second handle section; tips of the first handle section and the second handle section are rotatably mounted in the grooves.

In the workbench provided in the invention, the handle further includes two supporting bars with tips thereof rotatably fitted into the grooves respectively and top ends thereof slidably provided on the first handle section or the second handle section by a fastener; the fastener includes a sleeve which is slidable on the first handle section or the second handle section, a fastening bar and a positioning hole provided on the first handle section and the second handle section, the fastening bar is provided with a positioning projection at an upper end thereof, and the center of the fastening bar is rotatably connected on the sleeve.

In the workbench provided in the invention, the supporting leg is detachably connected beneath the operating panel.

In the workbench provided in the invention, a spherical groove is provided at the bottom end of the supporting leg and has a spherical axis therein, and a first mat is provided below the spherical axis.

In the workbench provided in the invention, an axis is provided at the top end of the supporting leg and is connected to the operating panel, the supporting leg is rotatably around the axis and is accommodated below the operating panel after the rotation.

In the workbench provided in the invention, a circular groove is provided at the bottom end of the supporting leg and has a circular axis therein, and a second mat is provided below the circular axis.

In the workbench provided in the invention, the supporting leg has a first supporting leg section and a second supporting leg section which are coaxial, and the first supporting leg section is accommodated in the second supporting leg section.

In the workbench provided in the invention, spring strips are provided at bottom of the operating panel, and are clamped and fastened to the supporting legs which have been folded and accommodated at bottom.

In the workbench provided in the invention, a surface of the operating panel has a length scale and an angle scale.

In the workbench provided in the invention, an edge of the operating panel is provided with a dragging pin.

In the workbench provided in the invention, a surface of the operating panel has a detachable tooling box with at least one accommodating space.

In the workbench provided in the invention, the bottom edge or the center of the tooling box is provided with fixing grooves and buckles which are fastened detachably to the third handle section.

In the workbench provided in the invention, at least one through hole penetrates the operating panel in the thickness direction, and the through hole is provided with a fitting portion and a hollow column portion; the fitting portion is provided at top of the through hole, and the hollow column portion radially penetrates the sidewall of the through hole.

The workbench provided in the invention further includes: a connector; a boss is provided at top of the connector, and a position limiting projection is provided at bottom of the connector; the boss is matched with the fitting portion; pin holes are provided at the sidewall of the connector; and the position limiting projection passes through the hollow column portion, and then is rotated and fixed at bottom of the operating panel.

The workbench according to the invention has different feeling in using and better humanization design with less operation difficulty compared with the conventional tables.

DESCRIPTION OF EMBODIMENTS

Figure 1:
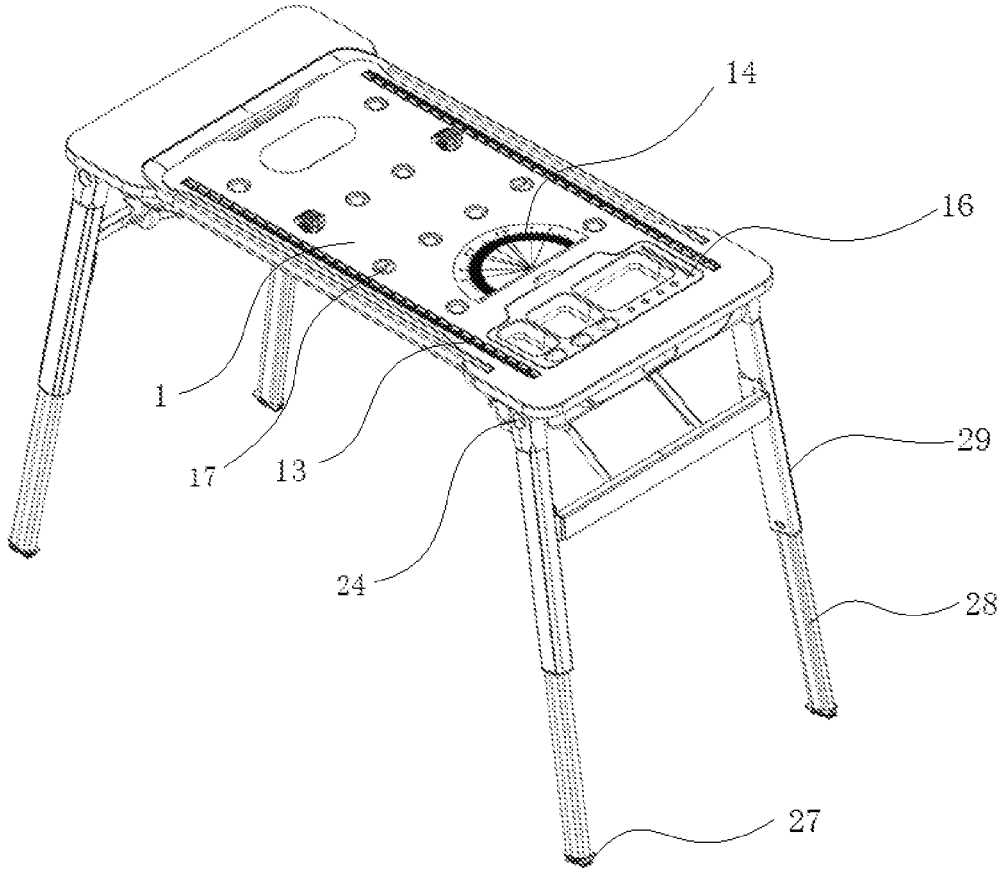
FIG. 1 is a schematic view of a folding leg workbench state according to the invention.

The invention will be described in detail in following embodiments with reference to the accompanying drawings. The process, condition, experiment or the like for embodying the invention are common knowledge and sense in the art and are not particularly limited in the embodiments, except those specified below.

As shown in FIGS. 1-21, the invention provides a workbench having an operating panel 1 and supporting legs 2 for supporting the operating panel from below. The operating panel is provided with a U-shaped or straight-shaped groove 11, in which a handle is fitted detachably; the handle includes a first handle section 31 and a second handle section 32 which are provided in parallel, and a third handle section 33 which connects a top end of the first handle section 31 and a top end of the second handle section 32; tips of the first handle section 31 and the second handle section 32 are rotatably mounted in the groove 11. The first handle section 31, the second handle section 32 and the third handle section 33 may be formed integrally.

In the workbench according to the invention, the handle further includes two supporting bars 34 with tips thereof rotatably fitted into the groove 11 respectively and top ends thereof slidably provided on the first handle section 31 or the second handle section 32 by a fastener 35. The fastener 35 includes a sleeve 351 which is slidable on the first handle section 31 or the second handle section 32, a fastening bar 352, and a positioning hole 36 provided on the first handle section 31 and the second handle section 32. The fastening bar 352 is provided with a positioning projection 353, and the center of the fastening bar 352 is rotatably connected on the sleeve 351. A spring is provided at the center of the fastening bar 352, which enables the upper end of the fastening bar apply a force on the handle. When the sleeve 351 slides to a certain position, the positioning projection 353 is fitted and fixed to the positioning hole 36, so that the handle is fixed. When the tip of the fastening 352 is pressed down, the positioning projection 353 is separated from the positioning hole 36, so that the sleeve 351 continues sliding along the first handle section 31 or the second handle section 32.

Figure 8:
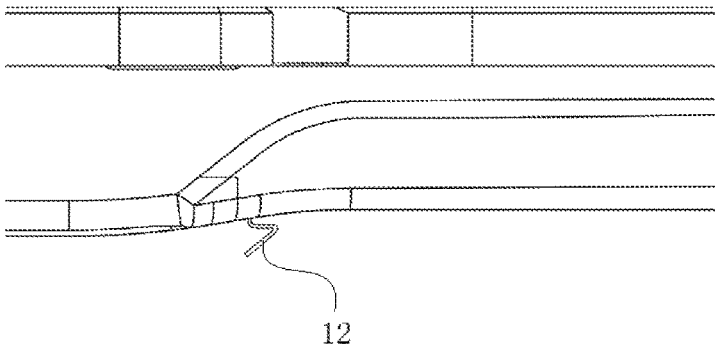
FIG. 8 is a structurally schematic view of the spring strip according to the invention.

As shown in FIG. 8, in the workbench according to the invention, a spring strip 12 is provided at bottom of the operating panel 1, and is clamped and fastened to the supporting leg 2 which has been folded and accommodated at bottom of the operating panel 1.

In the workbench according to the invention, a surface of the operating panel 1 has a length scale 13 and an angle scale 14.

Figure 7:
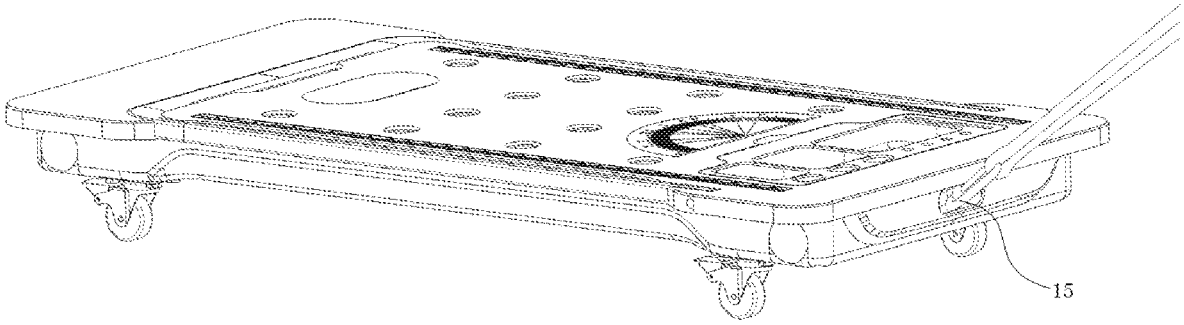
FIG. 7 is a schematic view of a folding leg tractor state according to the invention.

As shown in FIG. 7, in the workbench according to the invention, the edge of the operating panel 1 is provided with a dragging pin 15, which can be connected to a dragging rope, similarly to a tractor form.

In the workbench according to the invention, a surface of the operating panel 1 has a detachable tooling box 16 with at least one accommodating space 161.

Figure 2:
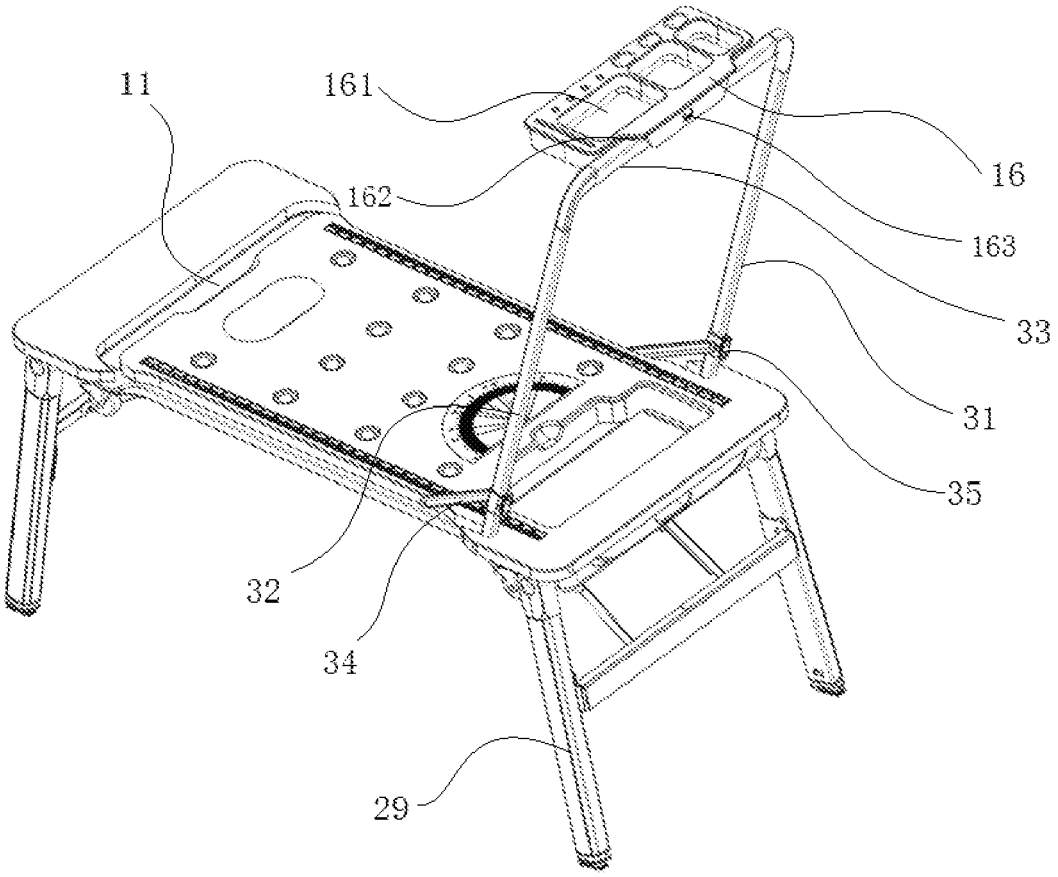
FIG. 2 is a schematic view of a folding leg aerial workbench state according to the invention.

As shown in FIG. 2, in the workbench according to the invention, the bottom edge or the center of the tooling box 16 is provided with a fixing groove 162 and a buckle 163 by which the third handle section 33 is fastened detachably.

Figure 9:
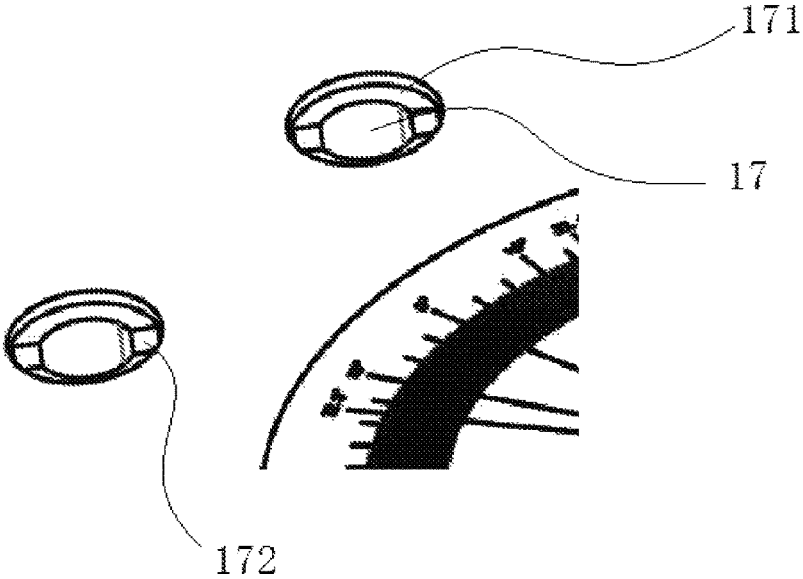
FIG. 9 is a structurally schematic view of the through hole according to the invention.

As shown in FIG. 9, in the workbench according to the invention, at least one through hole 17 penetrates the operating panel 1 in the thickness direction, and the through hole is provided with a fitting portion 171 and a hollow column portion 172. The fitting portion 171 is provided at top of the through hole 17, and the hollow column portion 172 radially penetrates the sidewall of the through hole 17.

Figure 11:
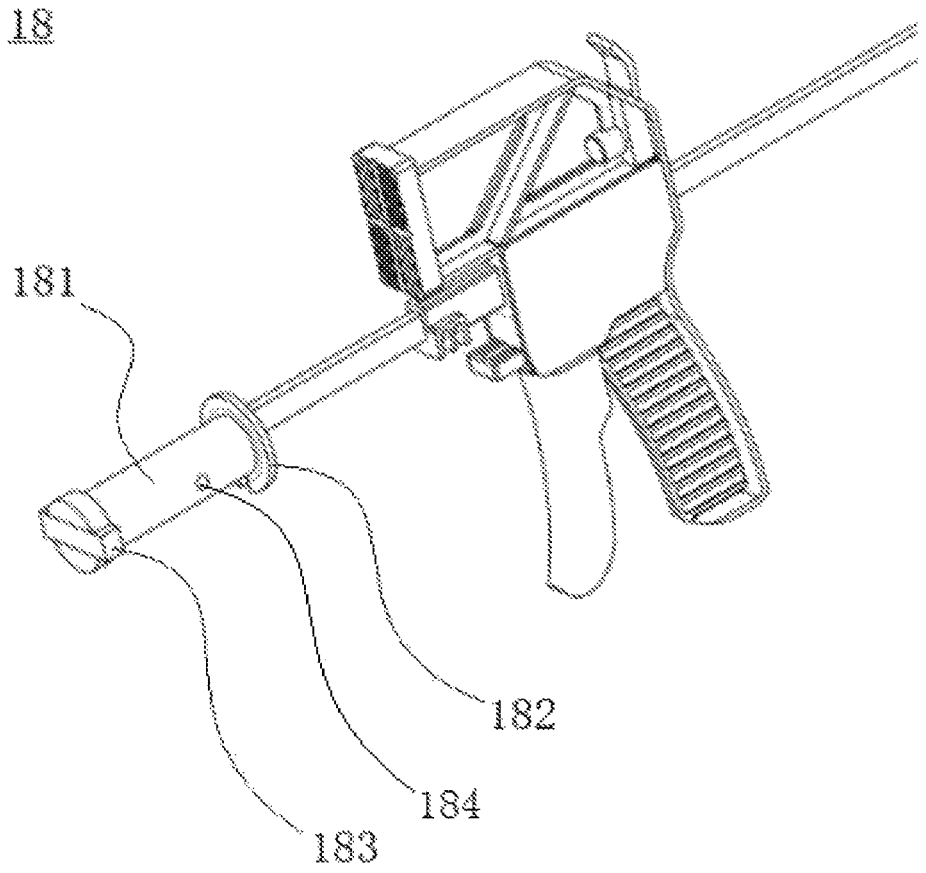
FIG. 11 is a structurally schematic view of the clamp according to the invention.

As shown in FIG. 11, the workbench according to the invention further includes a connector 181. A boss 182 is provided at top of the connector 181, and a position limiting projection 183 is provided at bottom of the connector 181. A pin hole 184 is provided at the sidewall of the connector 181. The boss 182 is matched with the fitting portion 171. The position limiting projection 183 passes through the hollow column portion 172, and then is rotated and fixed at bottom of the operating panel 1.

The connector 181 according to the invention can cooperate with the carpentry clamp for fixing a workpiece. A general carpentry clamp is composed of three parts: a large plastic piece being a movable piece which can move in one direction (not move reversely) under an operation of a lever, and it is necessary to press an unlock button when its move is locked and it is needed to be unlocked; a small plastic piece which can be taken off; and an iron lever of the clamp, which is provided with a lock hole thereon. In the invention, the clamp is inserted into the connector 181 after removing the small plastic piece of the clamp, and forms a lock by inserting a pin through the pin hole 184 into the lock hole. Then, the connector 181 can be inserted into a multiple through holes 17 on the table, thereby easily fixing a workpiece.

In the invention, there may be a carpentry clamp on the connector 181 which connects with the clamp 18, for fixing a matter, or there may be a backer for limiting a matter.

The invention can select a folding leg mode or a quick release leg mode based on the actual demand.

In the quick release leg mode according to the invention, the supporting legs 2 are detachably connected beneath the operating panel 1. Circular holes are provided at bottom of the operating panel 1, and the supporting legs can be directly inserted into the circular holes. The supporting leg 2 is provided with a common elastic buckle for fixing. The supporting leg 2 can be detached quickly by pressing the elastic buckle. A spherical groove 21 is provided at the bottom end of the supporting leg 2 and has a spherical axis 22 therein which can rotate by 360 degrees, and a first mat 23 is provided below the spherical axis 22.

In the folding leg mode according to the invention, an axis 24 is provided at the top end of the supporting legs 2 and is connected to the operating panel 1, the supporting legs 2 are rotatably around the axis 24 and are accommodated below the operating panel 1 after the rotation. A circular groove 25 is provided at the bottom end of the supporting leg 2 and has a circular axis 26 therein which can move straightly in the circular groove 25; and a second mat 27 is provided below the circular axis 26. The supporting leg 2 has a first supporting leg section 28 and a second supporting leg section 29 which are coaxial, and the first supporting leg section 28 can be accommodated in the second supporting leg section 29.

The invention can select a roller provided at bottom of the operating panel based on the actual demand, and the roller can be equipped with brakes or the like.

The invention may have multiple working states in use.

FIG. 1 shows a folding leg workbench state according to the invention.

FIG. 2 shows a folding leg aerial workbench state according to the invention, in which the supporting legs 2 are shrinked and the handle is pulled up so that the tooling box 16 can be easily taken out from the workbench and put on the handle. When a user stands on the operating panel 1 to work, the user can easily put the pieces or tools on the operating panel without squatting.

FIG. 7 shows a folding leg tractor state according to the invention.

Figure 12:
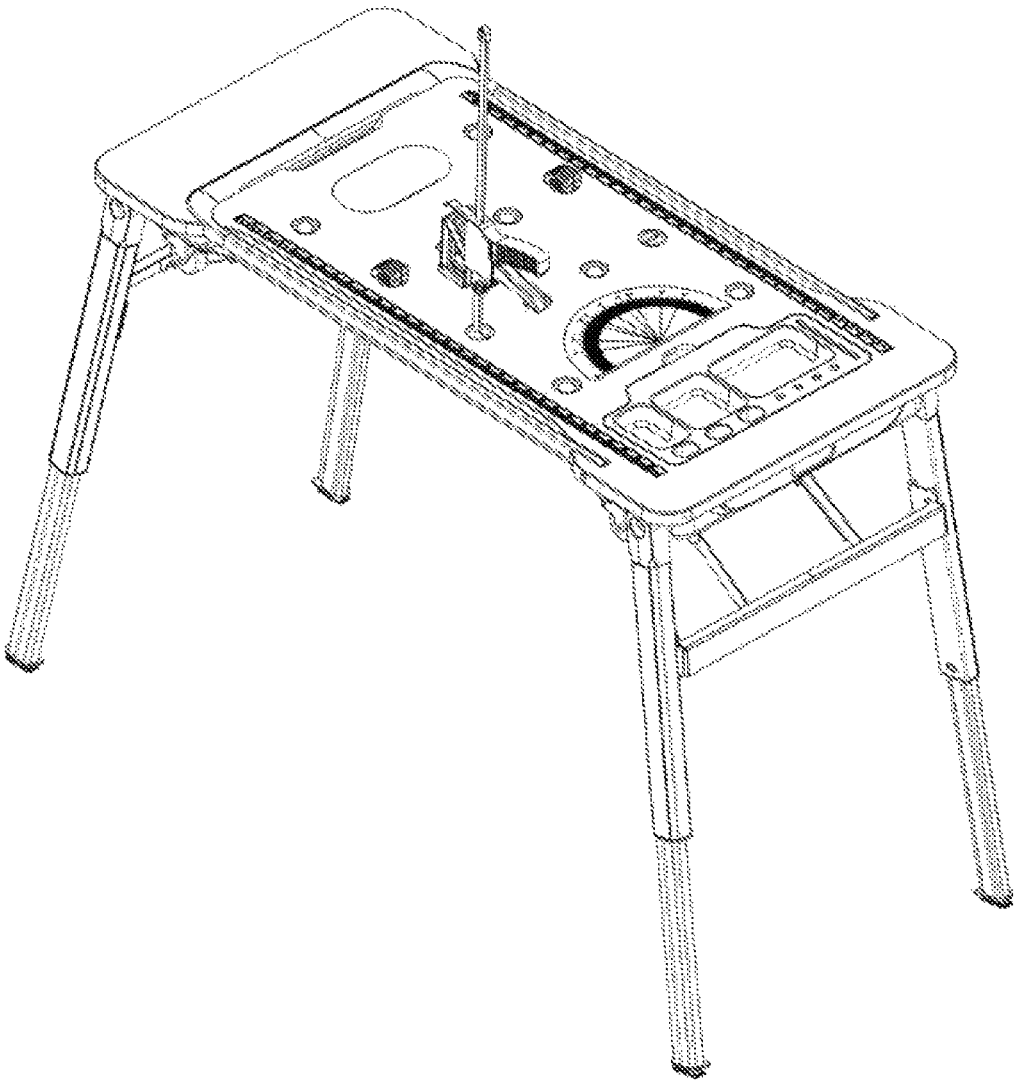
FIG. 12 is a schematic view of a folding leg sawhorse state according to the invention.

FIG. 12 shows a folding leg sawhorse state according to the invention. The sawhorse state is a ramification of the workbench and has additionally a clamp 18 on basis of the table, so that the user can easily process workpieces when operating.

Figure 13:
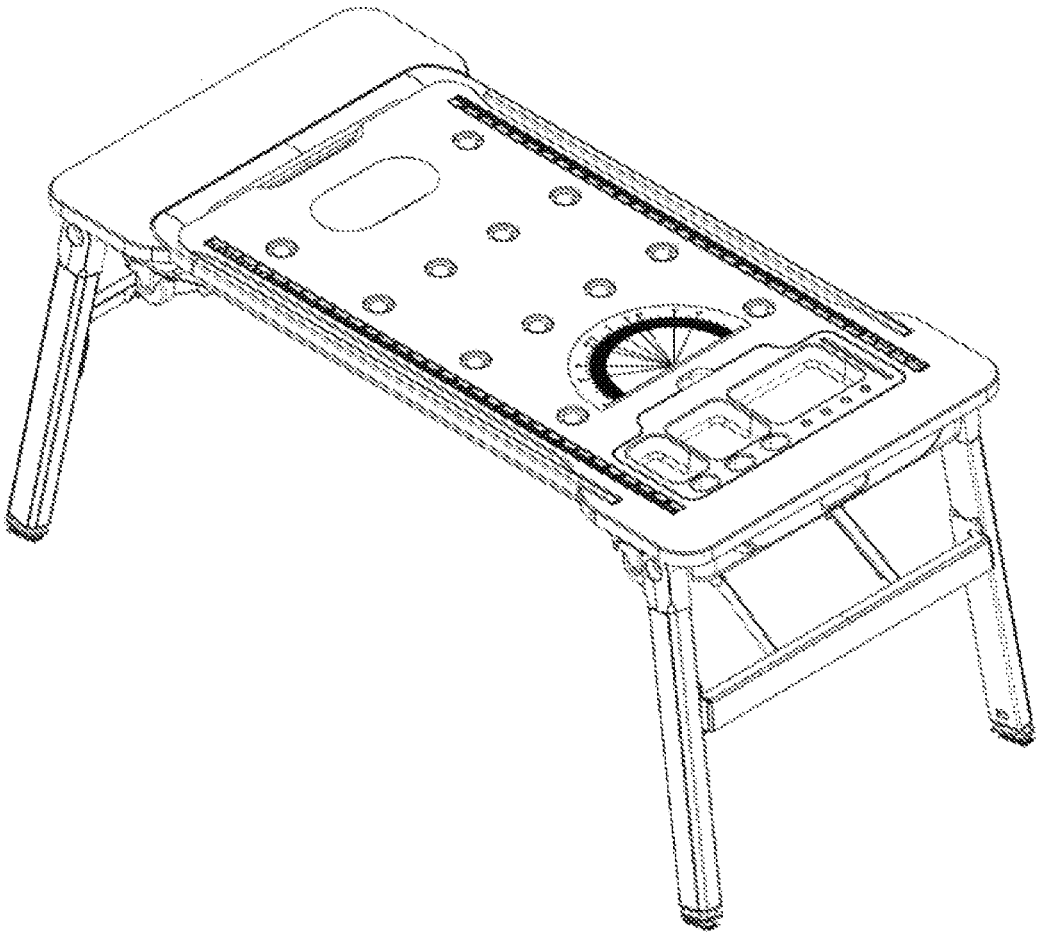
FIG. 13 is a schematic view of a folding leg horse block state according to the invention.

FIG. 13 shows a folding leg horse block state according to the invention, in which the supporting legs are shrinked so that a user can stand on the operating panel 1.

Figure 14:
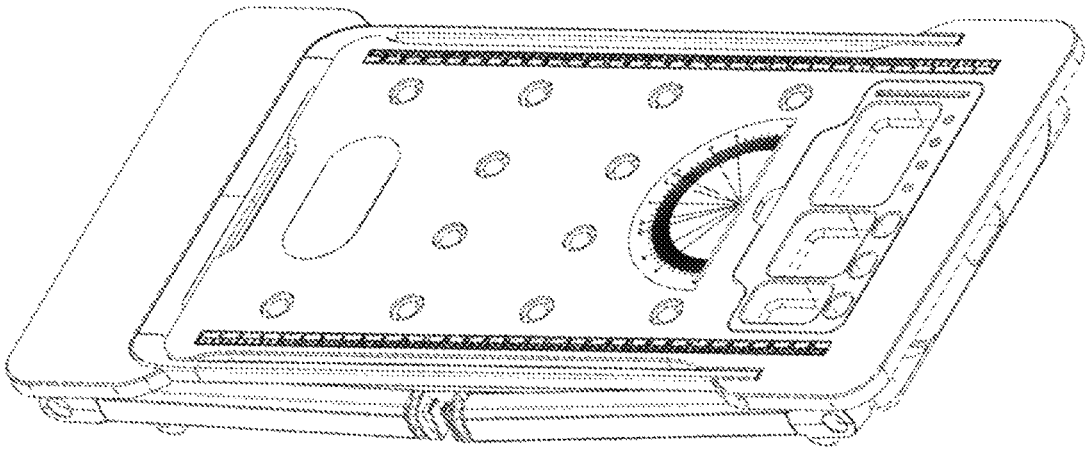
FIG. 14 is a schematic view of a folding leg truck reclining board state according to the invention.

FIG. 14 shows a folding leg truck reclining board state according to the invention, in which the supporting legs are accommodated at both sides below the operating panel 1, so that a user can lie and slide on the operating panel 1.

Figure 15:
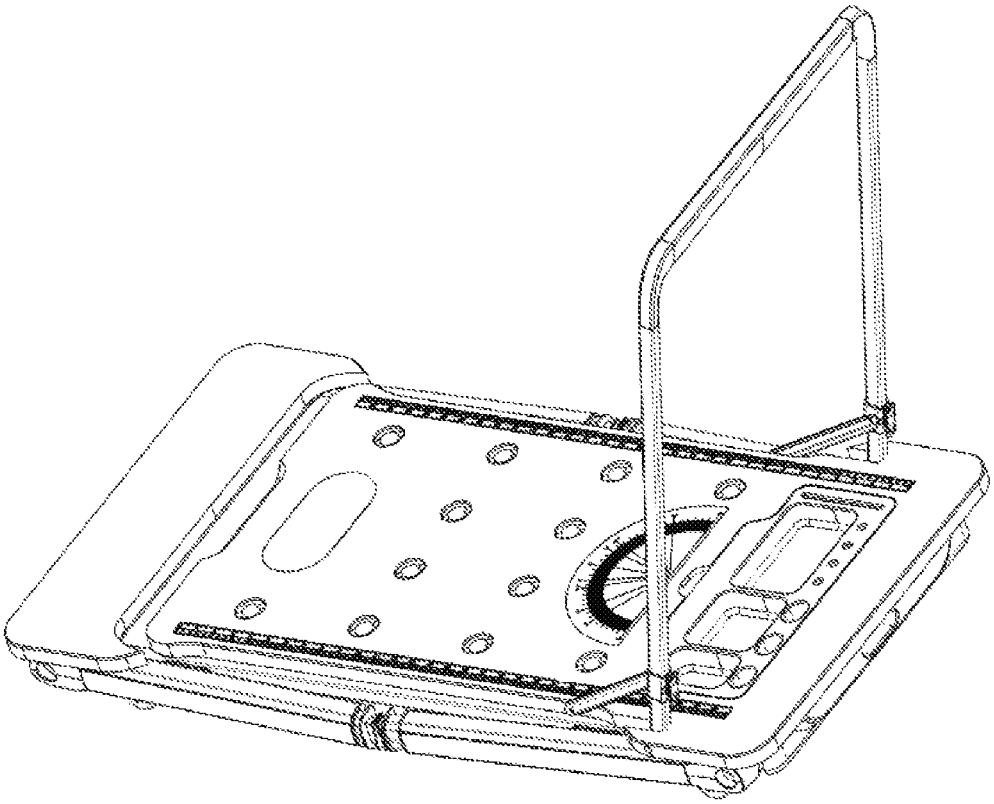
FIG. 15 is a schematic view of a folding leg barrow state according to the invention.

FIG. 15 shows a folding leg barrow state according to the invention, in which the handle is directly pulled out from the groove 11 and is automatically fixed, so that a user can put and push articles on the operating panel 1.

Figure 3:
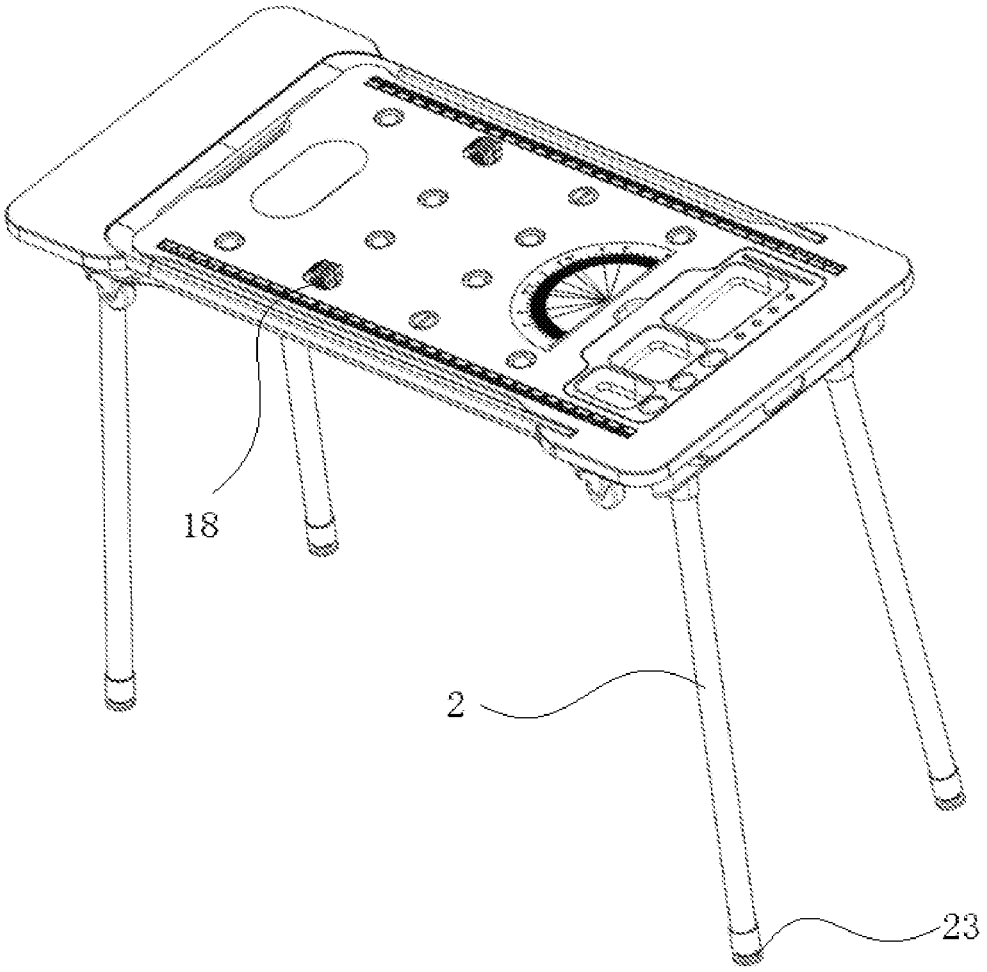
FIG. 3 is a schematic view of a quick release leg workbench state according to the invention.
Figure 4:
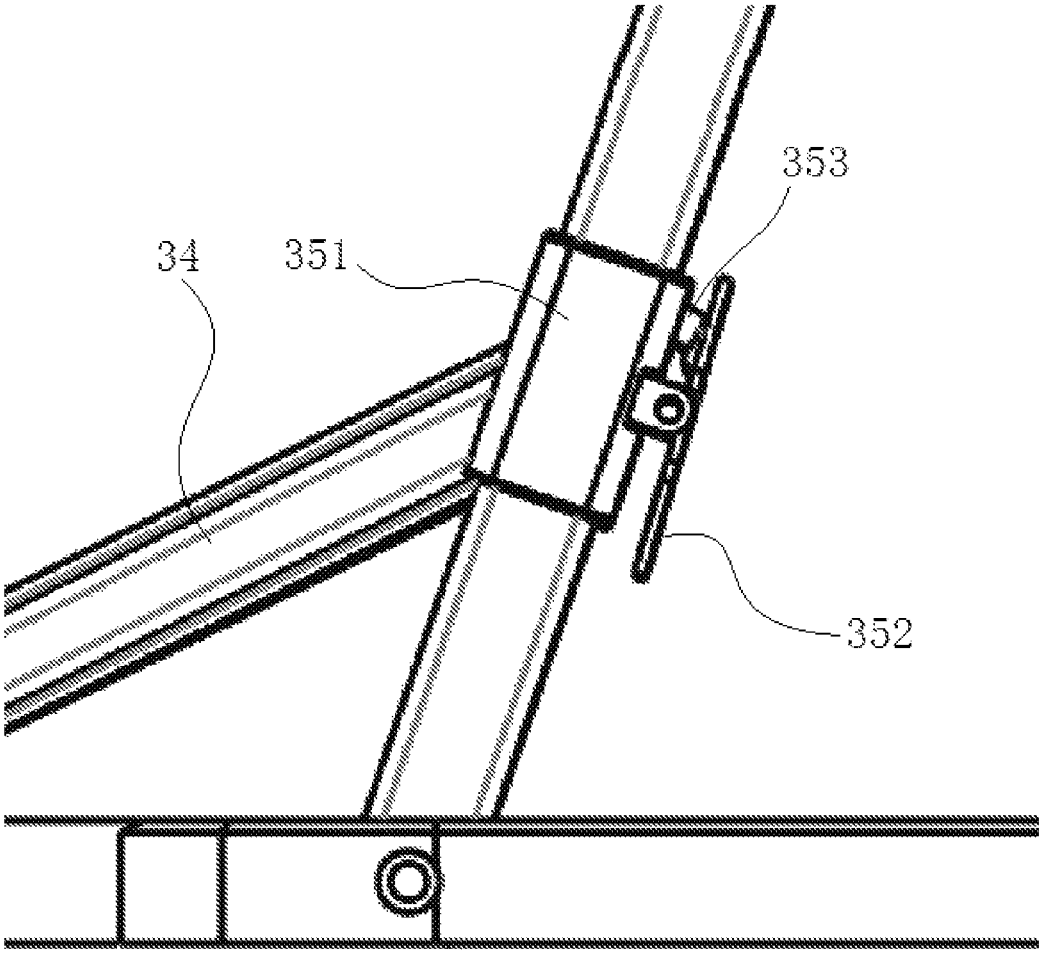
FIG. 4 is a structurally schematic view of the fastener according to the invention.
Figure 5:
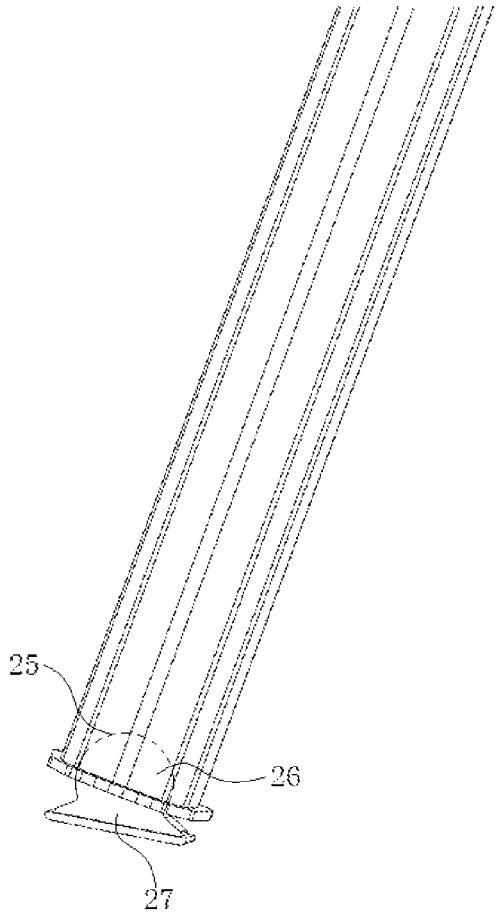
FIG. 5 is a structurally schematic view of the first mat according to the invention.
Figure 6:
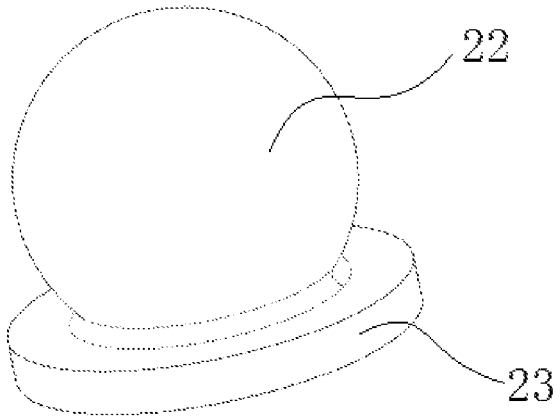
FIG. 6 is a structurally schematic view of the second mat according to the invention.

FIG. 3 shows a quick release leg workbench state according to the invention.

Figure 10:
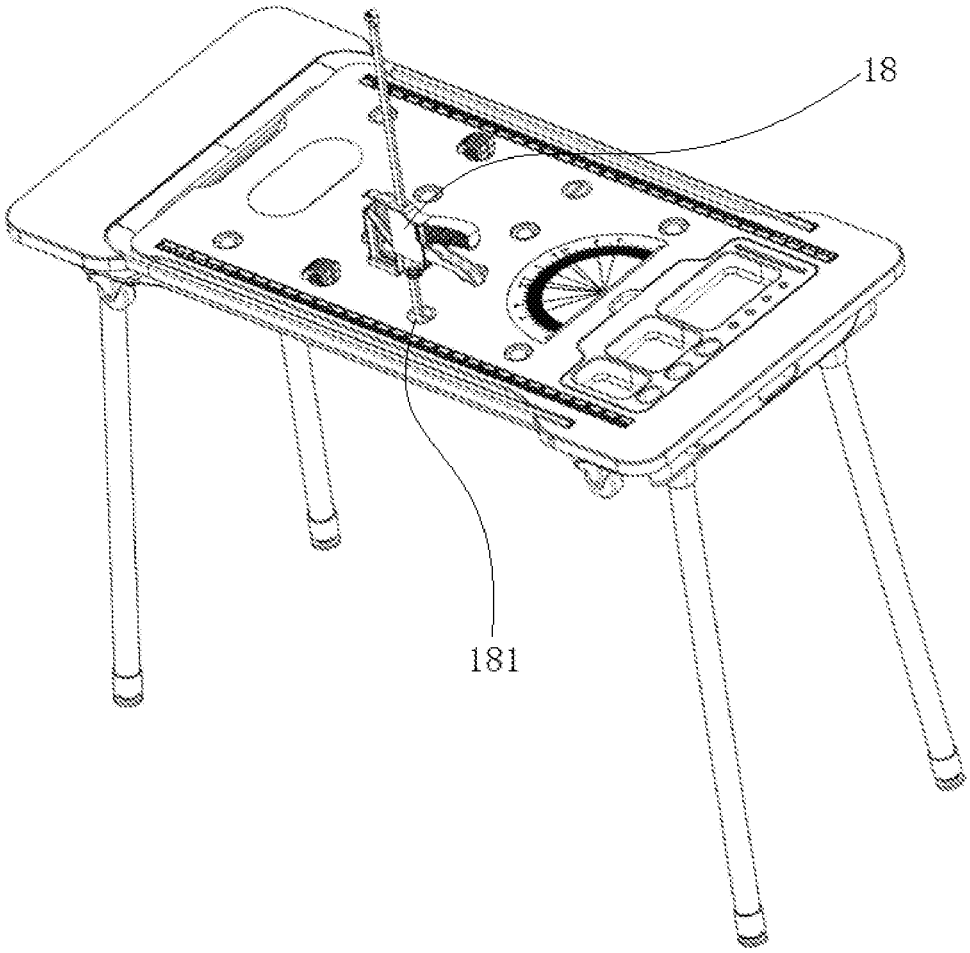
FIG. 10 is a schematic view of a quick release leg sawhorse state according to the invention.

FIG. 10 shows a quick release leg sawhorse state according to the invention.

Figure 16:
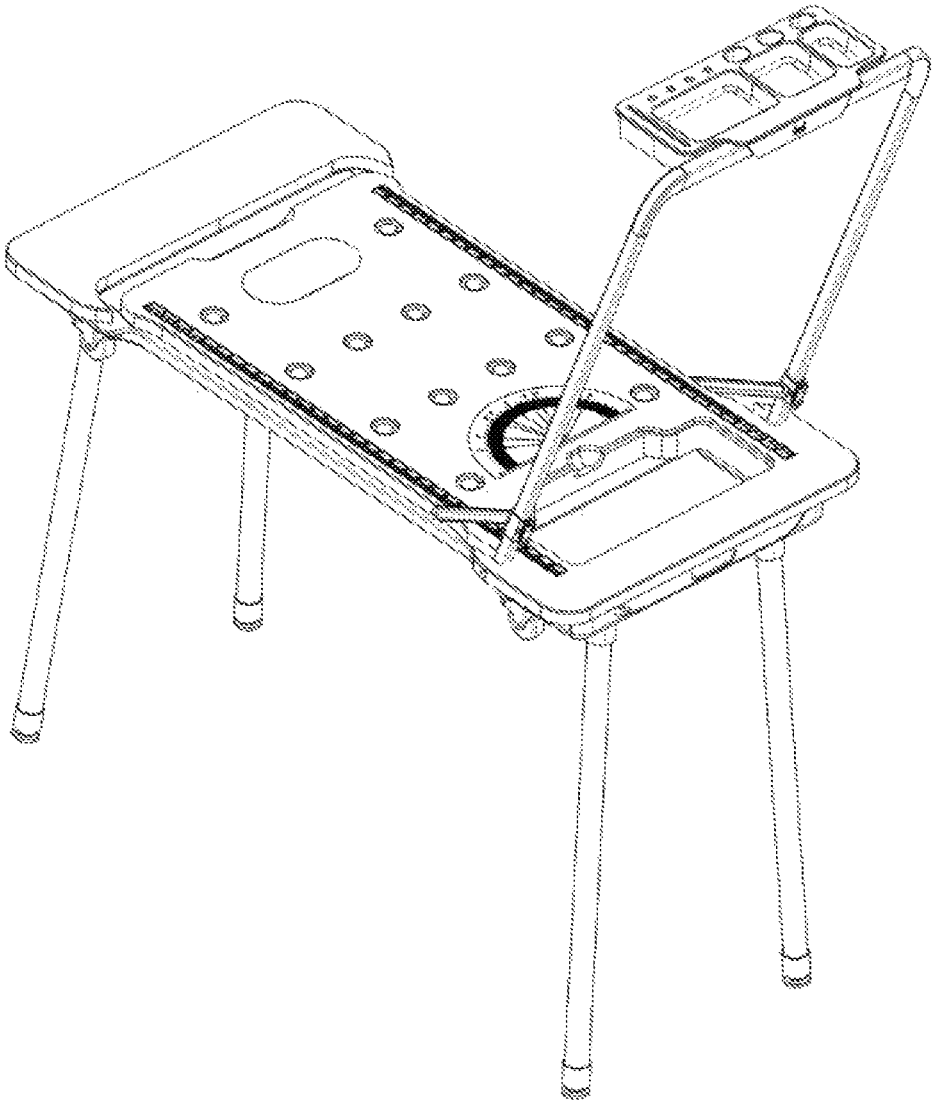
FIG. 16 is a schematic view of a quick release leg aerial workbench state according to the invention.

FIG. 16 shows a quick release leg aerial workbench state according to the invention.

Figure 17:
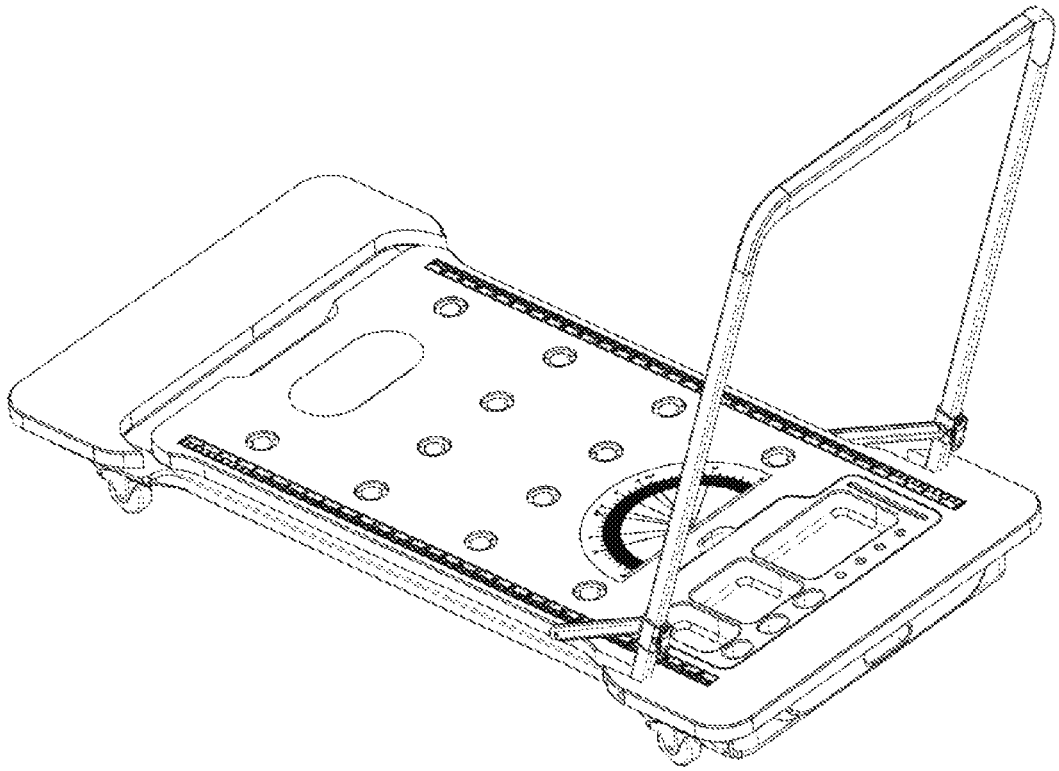
FIG. 17 is a schematic view of a quick release leg barrow state according to the invention.

FIG. 17 shows a quick release leg barrow state according to the invention.

Figure 18:
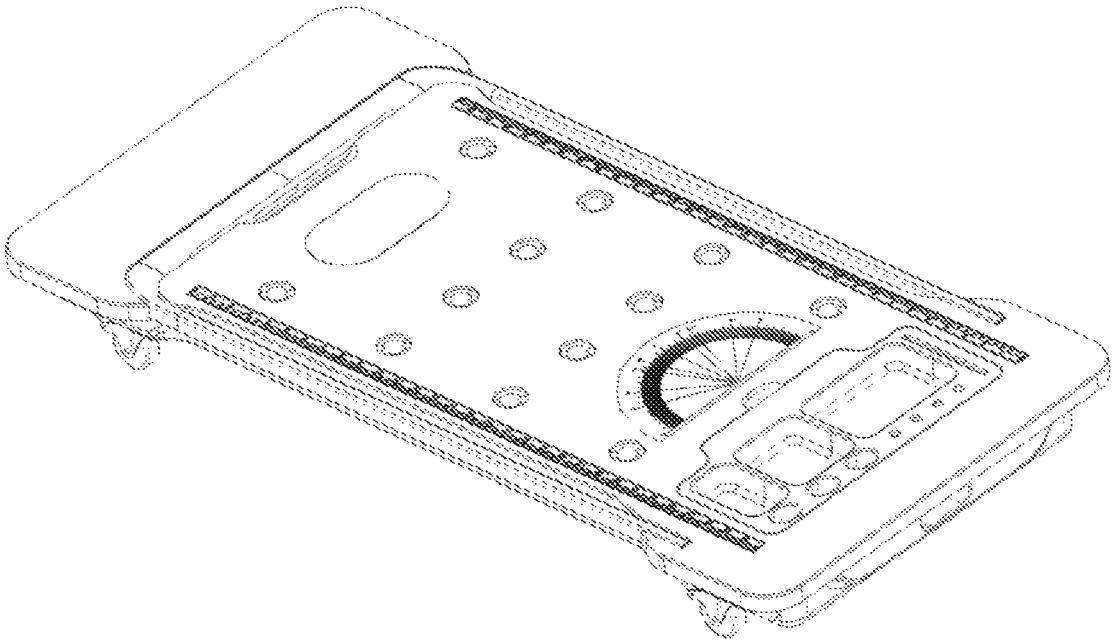
FIG. 18 is a schematic view of a quick release leg truck reclining board and tractor state according to the invention.
Figure 19:
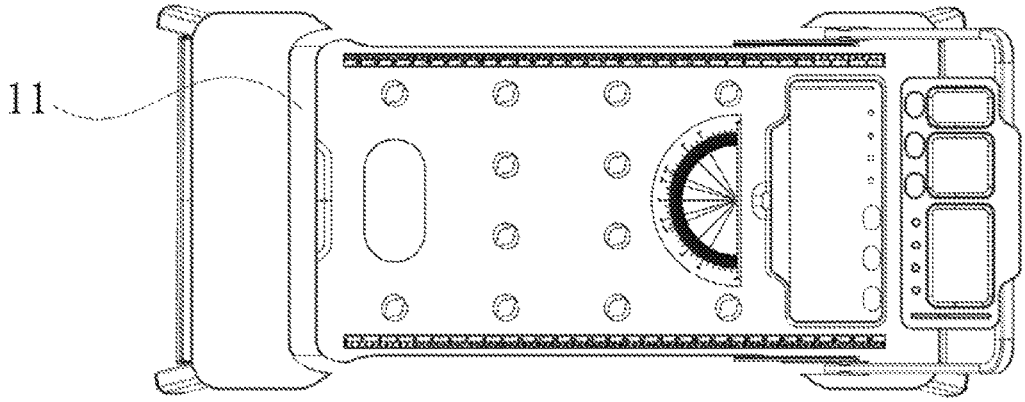
FIG. 19 is a top view of the workbench according to the invention.
Figure 20:
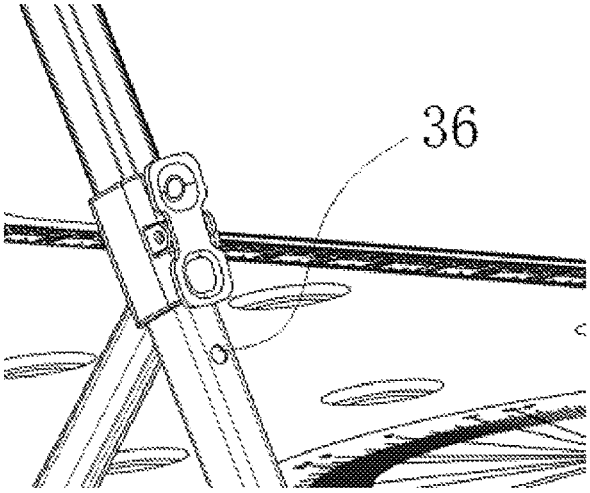
FIG. 20 is a schematic view of the setting of the positioning hole according to the invention.
Figure 21:
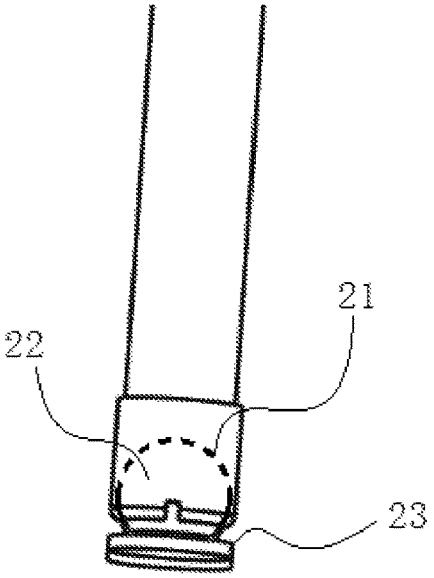
FIG. 21 is a structurally schematic view of the spherical groove according to the invention.

FIG. 18 shows a quick release leg truck reclining board and tractor state according to the invention.

The protection scope of the invention is not limited to above embodiments. Various changes and advantages which can be thought of by those skilled in the art are included in the invention, without departing from the spirit and scope of the invention, and the Claims claimed are as the protection scope.

What is claimed is:

1. A workbench having comprising:

an operating panel having a top surface and a bottom surface; and a supporting leg for supporting the operating panel from below, wherein the top surface of the operating panel is provided with grooves, in which a handle is fitted detachably, the grooves including a first groove extending along a first edge of the operating panel, a second groove extending along a second edge of the operating panel and a third groove extending across a width of the operating panel and between the first groove and the second groove, wherein the handle includes a first handle section and a second handle section which are provided in parallel, and a third handle section which connects a top end of the first handle section and a top end of the second handle section, wherein bottom ends of the first handle section and the second handle section are rotatably mounted in the grooves respectively, and wherein the first handle section fits within the first groove, the second handle section fits within the second groove and the third handle section fits within the third groove.

2. The workbench according to claim 1, wherein the handle further includes two supporting bars with bottom ends thereof rotatably fitted into the first groove and second groove, respectively and top ends thereof slidably provided on the first handle section or the second handle section, respectively, by a fastener, wherein the fastener includes a sleeve which is slidable on the first handle section or the second handle section, a fastening bar and a positioning hole provided on the first handle section and the second handle section, wherein the fastening bar is provided with a positioning projection at the upper end thereof, and the fastening bar is rotatably connected on the sleeve at a center thereof.

3. The workbench according to claim 1, wherein the supporting leg is detachably connected below the operating panel.

4. The workbench according to claim 1, wherein a spherical groove is provided at a bottom end of the supporting leg and has a spherical axis therein, and a first mat is provided below the spherical axis.

5. The workbench according to claim 1, wherein an axis is provided at a top end of the supporting leg and is connected to the operating panel, and wherein the supporting leg is rotatably around the axis and is accommodated below the operating panel after the rotation.

6. The workbench according to claim 1, wherein a circular groove is provided at a bottom end of the supporting leg and has a circular axis therein, and a second mat is provided below the circular axis.

7. The workbench according to claim 1, wherein the supporting leg has a first supporting leg section and a second supporting leg section which are coaxial, and the first supporting leg section is accommodated in the second supporting leg section.

8. The workbench according to claim 1, wherein a spring strip is provided at the bottom surface of the operating panel, and is clamped and fastened to the supporting leg which has been folded and accommodated at the bottom surface of the operating table.

9. The workbench according to claim 1, wherein the top surface of the operating panel is provided with a length scale and an angle scale.

10. The workbench according to claim 1, wherein an edge of the operating panel is provided with a dragging pin.

11. The workbench according to claim 1, wherein the top surface of the operating panel has a detachable tooling box with at least one accommodating space, the detachable tooling box fitting within the at least one accommodating space.

12. The workbench according to claim 11, wherein an edge of the tooling box is provided with a fixing groove to detachably secure the tooling box to the third handle section.

13. The workbench according to claim 1, wherein at least one through hole penetrates the operating panel in the thickness direction, the through hole is provided with a fitting portion and a hollow column portion, and wherein the fitting portion is provided at a top of the through hole, and the column portion forms a sidewall of the through hole.

14. The workbench according to claim 13 further comprising:

a connector fitting within the through hole;

a boss provided at top of the connector, and a position limiting projection provided at bottom of the connector;

a pin hole provided at a sidewall of the connector;

wherein the boss has a size matching the fitting portion; and wherein the position limiting projection passes through the hollow column portions, and then is rotated and fixed at the bottom surface of the operating panel.

15. The workbench according to claim 3, wherein a spherical groove is provided at a bottom end of the supporting leg and has a spherical axis therein, and a first mat is provided below the spherical axis.

16. The workbench according to claim 5, wherein a circular groove is provided at a bottom end of the supporting leg and has a circular axis therein, and a second mat is provided below the circular axis.

17. The workbench according to claim 5, wherein the supporting leg has a first supporting leg section and a second supporting leg section which are coaxial, and the first supporting leg section is accommodated in the second supporting leg section.

18. The workbench according to claim 5, wherein a spring strip is provided at the bottom surface of the operating panel, and is clamped and fastened to the supporting leg which has been folded and accommodated at the bottom surface of the operating panel.

19. The workbench according to claim 5, further comprising wheels attached to the bottom surface of the operating panel, wherein the wheels extend below the supporting leg when the supporting leg is rotated and accommodated below the operating panel after the rotation.

* * * * *